US007750256B2

(12) United States Patent
Looi

(10) Patent No.: US 7,750,256 B2
(45) Date of Patent: Jul. 6, 2010

(54) ROTARY SWITCH ASSEMBLY

(75) Inventor: Kok Eng Looi, Penang (MY)

(73) Assignee: Sony EMCS (Malaysia) Sdn. Bhd, Kuala Lumpur (MY)

( * ) Notice: Subject to any disclaimer, the term of this patent is extended or adjusted under 35 U.S.C. 154(b) by 239 days.

(21) Appl. No.: 11/943,757

(22) Filed: Nov. 21, 2007

(65) Prior Publication Data

US 2008/0130866 A1 Jun. 5, 2008

(30) Foreign Application Priority Data

Nov. 22, 2006 (MY) ..... PI 2006 4548

(51) Int. Cl.
*H01H 19/02* (2006.01)

(52) U.S. Cl. ..... 200/4; 200/14

(58) Field of Classification Search ..... 200/4, 200/5 R, 6 A, 17 R, 18, 336, 14; 341/35; 345/184

See application file for complete search history.

(56) References Cited

U.S. PATENT DOCUMENTS

| | | | | |
|---|---|---|---|---|
| 4,910,503 | A * | 3/1990 | Brodsky | 345/161 |
| 6,003,367 | A * | 12/1999 | Bux et al. | 73/462 |
| 6,974,921 | B2 * | 12/2005 | Jørgensen et al. | 200/14 |
| 7,053,320 | B2 * | 5/2006 | Kodo et al. | 200/17 R |
| 7,091,430 | B1 * | 8/2006 | Haizima et al. | 200/6 A |

FOREIGN PATENT DOCUMENTS

| | | |
|---|---|---|
| JP | 57-31605 | 7/1982 |
| JP | 57-135034 | 8/1982 |
| JP | 59-59040 | 4/1984 |
| JP | 60-59835 | 4/1985 |
| JP | 1-17058 | 5/1989 |
| JP | 03-026580 | 2/1991 |
| JP | 2004-095242 | 3/2004 |

* cited by examiner

*Primary Examiner*—Michael A Friedhofer
(74) *Attorney, Agent, or Firm*—Oblon, Spivak, McClelland, Maier & Neustadt, L.L.P.

(57) ABSTRACT

A rotary switch assembly (100; 200) is disclosed. The assembly may include a dial assembly (102; 202) having a main body (150; 250) disposed about a centre aperture (132; 232). The main body may be rotatable about a central axis (126; 226) in both a clockwise (106; 206) and counter clockwise direction (108; 208). The dial assembly includes a projecting member (138; 238) extending outward from the main body. The assembly includes a switch (114; 214) having an actuator (156; 256) moveable between a first position (158; 258) and a second position (160; 260). The actuator is positioned such that when the dial assembly is rotated clockwise, the projecting member moves the actuator to the first position, and when rotated counter clockwise, the projecting member moves the actuator to the second position.

11 Claims, 6 Drawing Sheets

ROTARY SWITCH ASSEMBLY

FIELD OF THE INVENTION

The invention relates generally to rotary switch assemblies, and more specifically to rotary switch assemblies having low profiles.

BACKGROUND OF THE INVENTION

A conventional rotary switch is generally constructed as a device that has a rotating shaft connected to one terminal capable of making or breaking a connection to one or more other terminals. During operation, a user manipulates the switch to manually select a circuit.

Rotary switches are often mounted upon panels and other supporting structures in order that a user may control an electrical device. It is common for a portion of the switch to be on one side of the panel (the user side) and another portion of the switch to be on the other side of the panel (the inside). In many instances, the only portion of a switch that is on the user's side of the panel is a section of the shaft and a knob or other actuating means. Generally, the bulk of the switch is on the inside of the panel. For many years this type of configuration was sufficient, but over time the size of electrical devices became increasingly smaller and there became a need to reduce the size of the switch—especially that portion on the inside of the panel and the overall height of the switch.

In order to meet the needs of smaller devices having less room and of a lower profile, the size of the components of the switches also became smaller. Yet, because these switches are comprised in part of mechanical components, there remained a practical limit as to how small they could become while still remaining useful. There became a need for different designs rather than just a reduction in the size of the components. One such attempt at providing a solution is found in U.S. Pat. No. 7,109,430 B2 issued to Horton et al. While the switch described by Horton may have resulted in a lower overall profile of the combined components, this switch still does not address at least several problems. For instance, the rotary switch 100 is constructed such that the axis of rotation of the rotary shaft 130 can only be installed perpendicularly to the printed wiring board 150 (PWB). Further, the rotary shaft 130 occupies the centre of the rotary switch 100, thereby blocking the placement of a centre push style switch in that location. Also, the rotary switch 100 assembly is complicated in design, and requires the performance of costly and error prone manufacturing techniques. Moreover, the rotary switch 100 requires the construction and installation of an electrical contact 140 that has electrical contacts which sweep across the PWB 150 selectively making and breaking electrical connections. These connections are prone to increased rates of failure since they are subject to wear and contamination by dirt, etc.

Accordingly, the industry sought to improve upon the rotary switch disclosed in Horton. One such improvement to the switch disclosed in Horton has been to use a rotary switch having an annular shaped dial which may be rotated about a centre knob. The dial includes a plastic ring having a precision inset moulding used to selectively make and break electrical connections when the dial is rotated. A small and precision metal stamping activation spring is needed for connecting purposes. Although providing a lower profile than the Horton switch, these types of improved rotary switches are complicated and require special control injection manufacturing techniques to manufacture, and thus are costly to manufacture. Also, they are designed to be mounted only in one orientation, i.e. parallel to the PWB such that the axis of rotation of the dial is perpendicular to the PWB.

Accordingly, there exists a need for an improved rotary switch which has one or more of the following characteristics: a low profile, inexpensive to manufacture, reliable, less prone to failure, less complicated, does not require precision manufacturing techniques and components, which permits the use of a centre mounted switch assembly, and that is more versatile in the orientations in which it can be mounted relative to a PWB.

OBJECT OF THE INVENTION

It is an object of the invention to provide a rotary switch assembly that ameliorates at least some of the disadvantages and limitations of the above prior art.

SUMMARY OF THE INVENTION

One embodiment of a rotary switch assembly formed in accordance with the present invention is disclosed. The rotary switch assembly may include a dial assembly having a main body disposed about a centre aperture. The main body may be rotatable about a central axis in both a clockwise direction and a counter clockwise direction. The dial assembly may include at least one projecting member extending outward from the main body. The rotary switch assembly may also include a switch having an actuator moveable in a first direction to a first position for activating a first circuit. The switch may be moveable in a second direction to a second position for activating a second circuit. The actuator may be positioned relative to the dial assembly such that when the dial assembly is rotated clockwise, the projecting member interacts with the actuator to result in the actuator moving in the first direction to the first position, and when the dial assembly is rotated counter clockwise, the projecting member interacts with the actuator to result in the actuator moving in the second direction to the second position.

The rotary switch assembly may include a push activated switch assembly disposed in the centre aperture about which the dial assembly is adapted to be rotated, the push activated switch assembly adapted to selectively activate an electrical circuit when activated. The rotary switch assembly may have a height, with the push activated switch assembly disposed in the centre aperture, less than about 10 mm. The height of the rotary switch assembly may be less than about 10 mm. The height of the rotary switch assembly may be less than about 5 mm. The outer diameter or width of the dial assembly may be less than about 50 mm, or even less, such as less than about 40, 30, or 25 mm.

The rotary switch assembly may be mountable to a printed wiring board such that the central axis is oriented substantially parallel to the printed wiring board. The projecting member may be oriented substantially perpendicular to the central axis and may extend radially outward from the main body of the dial assembly. The projecting member may be oriented to extend outward from the main body in a direction substantially parallel to the central axis. The projecting member may be oriented to extend outward from the main body in a direction substantially parallel to the central axis. The projecting member may include an outer facing cam surface adapted to engage the actuator as the dial assembly is rotated in the clockwise direction and an inner facing cam surface adapted to engage the actuator as the dial assembly is rotated in the counter clockwise direction.

The dial assembly may include at least a first recess and a second recess, wherein the rotary switch assembly includes a biasing assembly for biasing a retaining member into either the first recess or the second recess to hold the dial assembly in a selected position. When the dial assembly is rotated, the retaining member may be adapted to be driven from the first recess to the second recess or from the second recess to the first recess. The actuator may be oriented substantially parallel to the central axis. The actuator may be oriented substantially perpendicular to the central axis. The actuator may be biased to normally reside in a central default position. The dial assembly may be rotated in the clockwise direction such that the projecting member drives the actuator from the central default position to the first position. The dial assembly may be rotated in the counter clockwise direction such that the projecting member drives the actuator from the central default position to the second position. The switch may be a two-way direction detector switch.

An alternative embodiment of a rotary switch assembly formed in accordance with the present invention is disclosed. The rotary switch assembly may include a dial assembly having a main body disposed about a centre aperture. The main body may be rotatable about a central axis in both a clockwise direction and a counter clockwise direction. The dial assembly may include at least one projecting member extending outward from the main body. The rotary switch assembly may include a two way direction detector switch having an actuator moveable in a first direction to a first position for activating a first circuit. The actuator may also be moveable in a second direction to a second position for activating a second circuit. The actuator may be positioned relative to the dial assembly such that when the dial assembly is rotated clockwise, the projecting member interacts with the actuator to result in the actuator moving in the first direction to the first position.

The actuator may also be positioned such that when the dial assembly is rotated counter clockwise, the projecting member interacts with the actuator to result in the actuator moving in the second direction to the second position. The rotary switch assembly may have a low profile having a height less than about 6 mm.

BRIEF DESCRIPTION OF THE DRAWINGS

The invention will now be described, by way of example only, by reference to the accompanying drawings.

DETAILED DESCRIPTION OF THE PREFERRED EMBODIMENT

The following description will describe the invention in relation to preferred embodiments of the invention, namely a rotary switch assembly. The invention is in no way limited to these preferred embodiments as they are used purely to exemplify the invention only and variations and modifications are readily apparent without departing from the scope of the invention.

Figure 1:
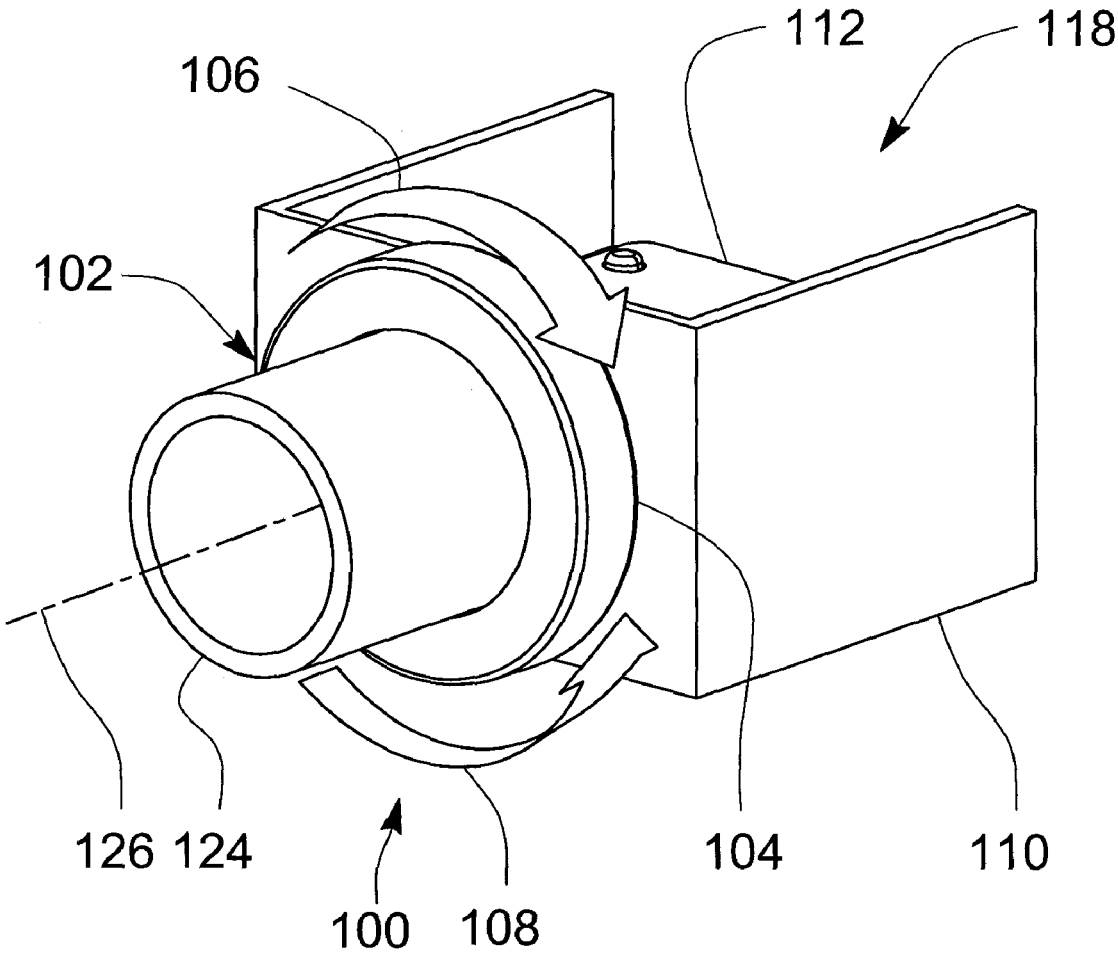
FIG. 1 is a front perspective view of one embodiment of a rotary switch formed in accordance with the present invention.
Figure 2:
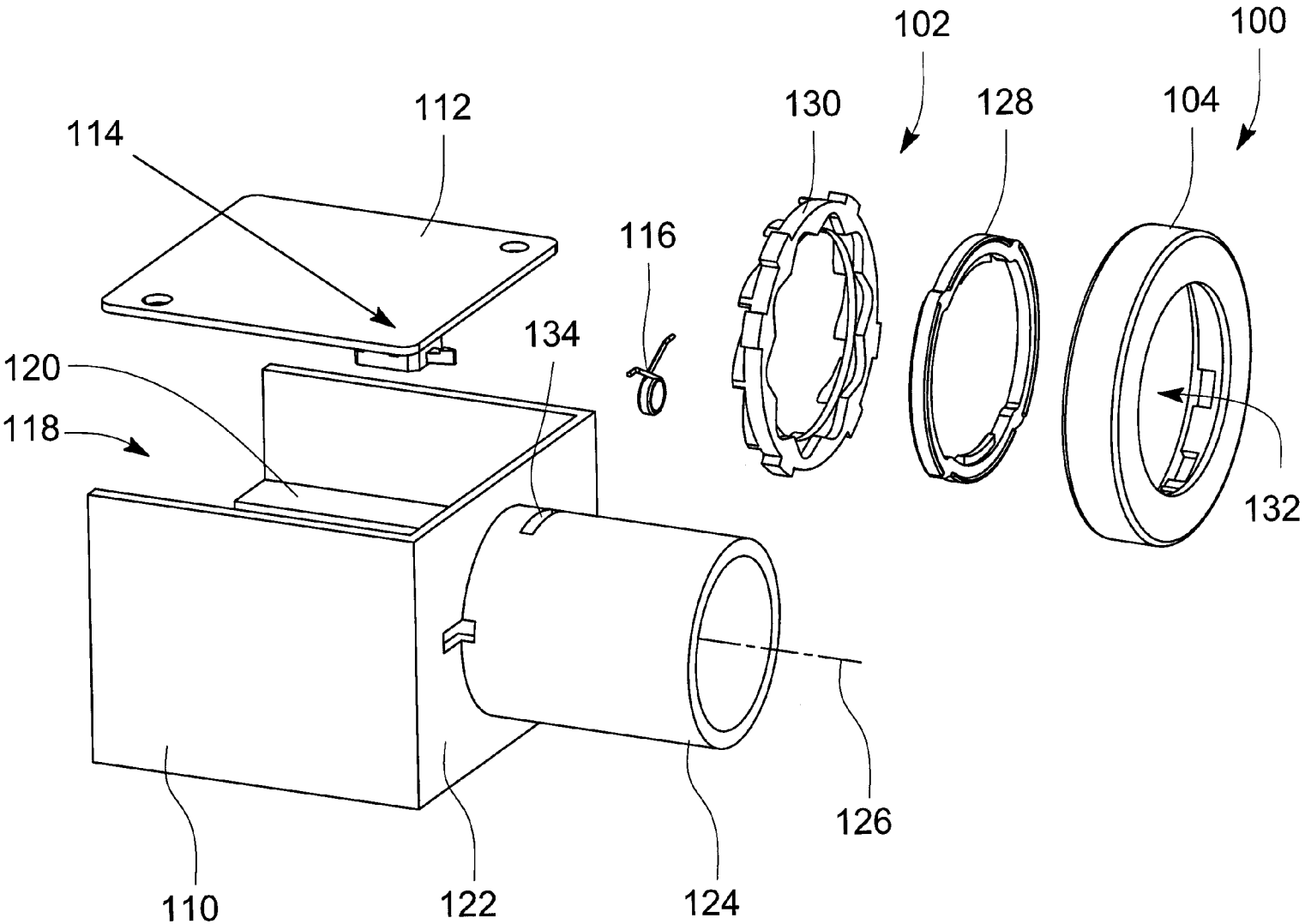
FIG. 2 is an exploded front view of the rotary switch assembly of FIG. 1.

Referring to FIGS. 1 and 2, one embodiment of a rotary switch assembly 100 formed in accordance with the present invention is shown. Generally described, the rotary switch assembly 100 includes a dial assembly 102 having a rotary knob 104 which may be selectively rotated in either a clockwise direction 106 or a counter clockwise direction 108 to selectively activate circuits to result in the performance of a desired function, suitable examples being volume adjustment and scrolling through a list of menu items.

In light of the above general description of the rotary switch assembly 100, the parts of the rotary switch assembly 100 will now be described in greater detail. The rotary switch assembly 100 includes the dial assembly 102, a body case 110, a printed wiring board (PWB) 112, a switch 114, and a biasing assembly 116. The body case 110 includes a plurality of walls defining an interior space 118. The body case 110 also includes a plurality of support members 120 adapted to support the printed wiring board 112 within the interior space 118. Mounted to a front wall 122 of the body case 110 is a shaft 124. The shaft 124 may be cylindrical in shape, hollow or solid, and is preferably oriented such that a central axis 126 of the shaft 124 is oriented substantially parallel to the plane of the PWB 112. A push activated switch may be disposed within the hollow of the shaft 124 if desired or in replacement of the shaft 124.

The dial assembly 102 may include the rotary knob 104, a locking member 128, a propeller 130, and a central aperture 132. The rotary knob 104 may be an annular shaped member disposed about the central aperture 132. The central aperture 132 is shaped and configured to rotatingly receive the shaft 124 of the body case 110 and is preferably oriented concentrically with the central axis 126. The rotary knob 104 is adapted to be gripped by the user and rotated in either the clockwise 106 or counter clockwise 108 direction to result in the performance of a selected function by activating selected circuits on the PWB 112.

The locking member 128 may be an annular shaped member disposed about the central aperture 132 and adapted to be coupled to the rotary knob 104. The locking member 128 is also adapted to interface with a locking groove 134 on the shaft 124 to retain the dial assembly 102 upon the shaft 124 after installation.

Figure 3:
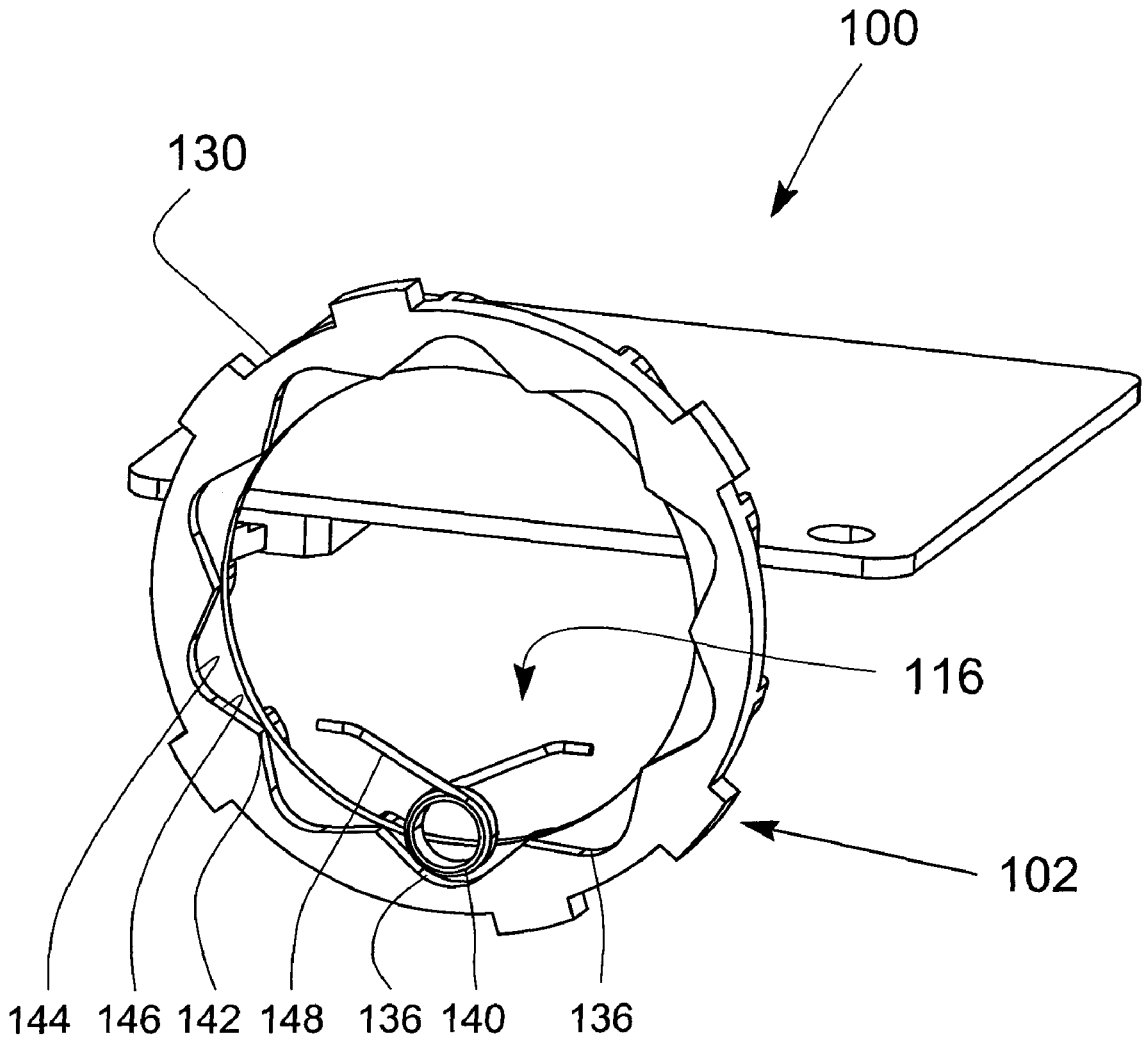
FIG. 3 is a front view of the rotary switch assembly of FIG. 1 with selected parts of the rotary switch removed to show underlying parts.
Figure 4:
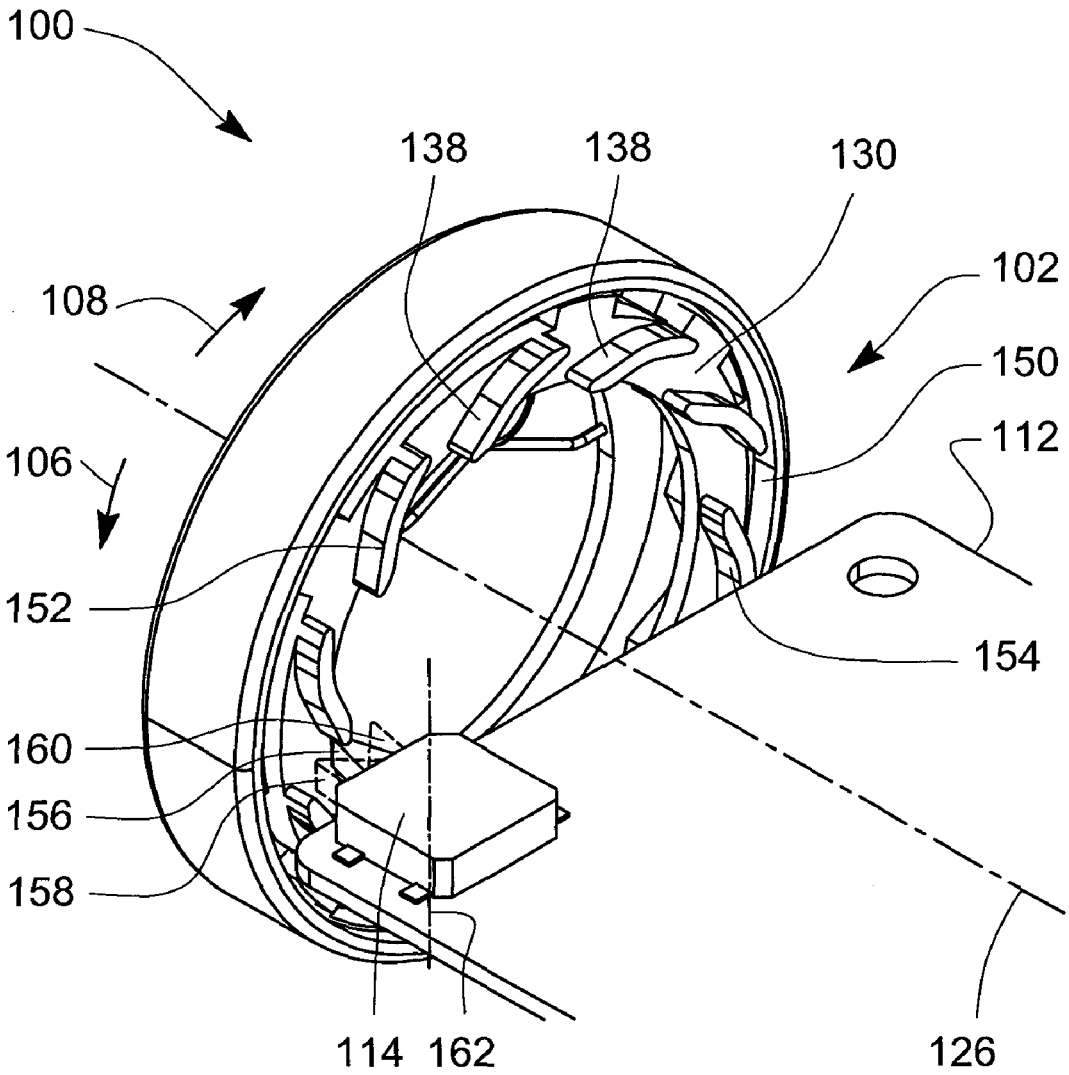
FIG. 4 is a rear view of the rotary switch assembly of FIG. 1 with selected parts of the rotary switch removed to show underlying parts.

The propeller 130 may also be an annular shaped member disposed about the central aperture 132 and adapted to be coupled to the rotary knob 104. Referring to FIGS. 3 and 4, the propeller 130 includes a plurality of recesses 136 and a plurality of projecting members 138 disposed about a circumference of the propeller 130. The recesses 136 are preferably formed by creating a series of radially oriented detents in the annular shaped body of the propeller 130, thereby creating a wave like pattern having crests 142 and troughs 144. The recesses 136 are preferably sized and shaped to receive a retaining member 140 of the biasing assembly 116. As the dial assembly propeller is rotated, the retaining member 140, which is biased radially outward, rides along an inner facing cam surface 146 from one recess 136 to the adjacent one, passing over a crest 142, and falling into a new trough 144, thereby holding the dial assembly 102 in a new position and providing a positive feedback feel to the user as they rotate the dial assembly 102.

In the illustrated embodiment, the biasing assembly 116 includes a coil spring 148 having ends which are rigidly attached to the body case of the rotary switch assembly 100.

The retaining member 140 is formed by the coiling of the wire forming the coil spring 148. Although a particular biasing assembly 116 is illustrated and described, it is noted that many biasing assemblies hereto known or to be developed may be used without departing from the scope of the present invention.

Turning to FIG. 4, the rotary switch assembly 100 is shown with the body case removed for clarity. FIG. 4 illustrates how the projecting members 138 extend outward from a main body 150 of the dial assembly 102, and in the illustrated body, extend outward from the propeller portion of the dial assembly 102. Preferably, the projecting members 138 extend outward from the main body 150 in a direction substantially parallel to the central axis 126. The projecting members 138 may include an outer facing cam surface 152 and an inner facing cam surface 154 each adapted to engage an actuator 156 of the switch 114. The outer facing cam surface 152 is preferably configured to engage the actuator 156 when the dial assembly 102 is rotated in the clockwise direction 106 and not when the dial assembly 102 is rotated in the counter clockwise direction 108. Similarly, the inner facing cam surface 154 is preferably configured to engage the actuator 156 when the dial assembly 102 is rotated in the counter clockwise direction 108 and not when the dial assembly 102 is rotated in the clockwise direction 106.

More specifically, when the dial assembly is rotated in the clockwise direction 106, the actuator engages and rides along the outer facing cam surface 152 resulting in the actuator moving radially outward from a neutral/default position, to a first position 158, in which a first circuit is activated, resulting in the commencement of a specific routine or function, for instance resulting in an increase in volume or the scrolling through a menu list in a first direction. The actuator 156 is preferably biased into the default position such that when dial assembly 102 is rotated further such that the actuator 156 disengages from the cam surface 152, or is rotated back to its original starting position, the actuator 156 is automatically returned to the default position.

When the dial assembly is rotated in the counter clockwise direction 108, the actuator engages and rides along the inner facing cam surface 154 resulting in the actuator moving radially inward from the neutral/default position, to a second position 160, in which a second circuit is activated, resulting in the commencement of a specific routine or function, for instance resulting in a decrease in volume or the scrolling through a menu list in a new direction. Since the actuator 156 is biased into the default position, when the dial assembly 102 is rotated further such that the actuator 156 disengages from the cam surface 154, or is rotated back to its original starting position, the actuator 156 is automatically returned to the default position. Preferably, the cam surfaces 152 and 154 are inclined relative to the outer circumference or perimeter of the dial assembly such that the distance between the cam surfaces 152 and 154 and the central axis 126 increases along the length of the projecting member 138.

The switch 114 is preferably a two-way direction detector switch. As noted above, the switch 114 includes an actuator 156 that may be selectively moved between a default/normal position to either a first position 158 or a second position 160. The actuator 156 may be biased so that the actuator 156 automatically returns to the default position. When in the first position 158, the switch 114 is adapted to activate a first circuit to result in the accomplishment of a predefined task. Likewise, when the actuator 156 is in the second position 160, the switch 114 is adapted to activate a second circuit to result in the accomplished of a different predetermined task. The switch 114 is preferably attached directly to the PWB 112 which contains all or a portion of the first and second circuits. The actuator 156 is preferably oriented parallel to the central axis 126 when in the default position, and is pivoted about an axis 162 oriented substantially perpendicular to the central axis 126 when transitioned to either the first or second positions 158 and 160.

Figure 5:
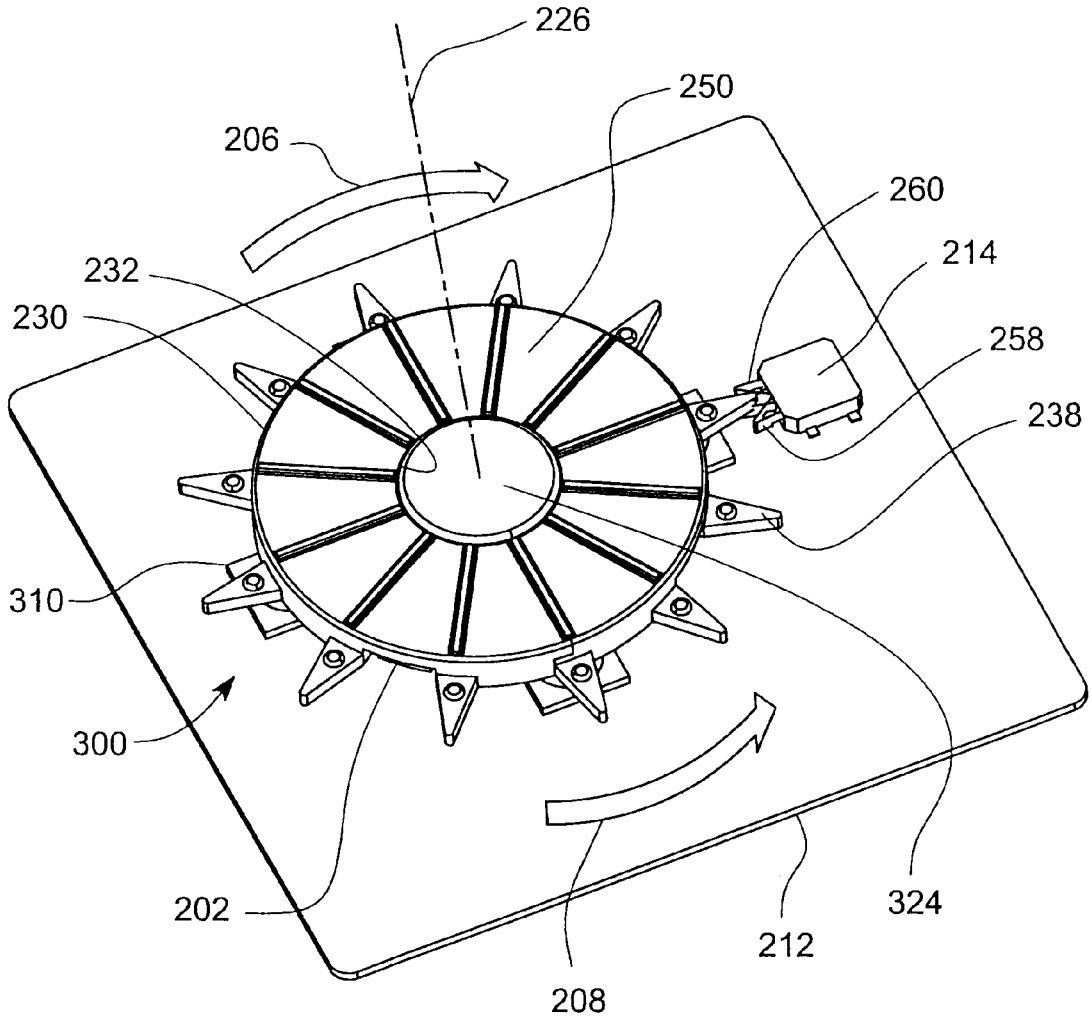
FIG. 5 is a top perspective view of an alternate embodiment of a rotary switch formed in accordance with the present invention.
Figure 6:
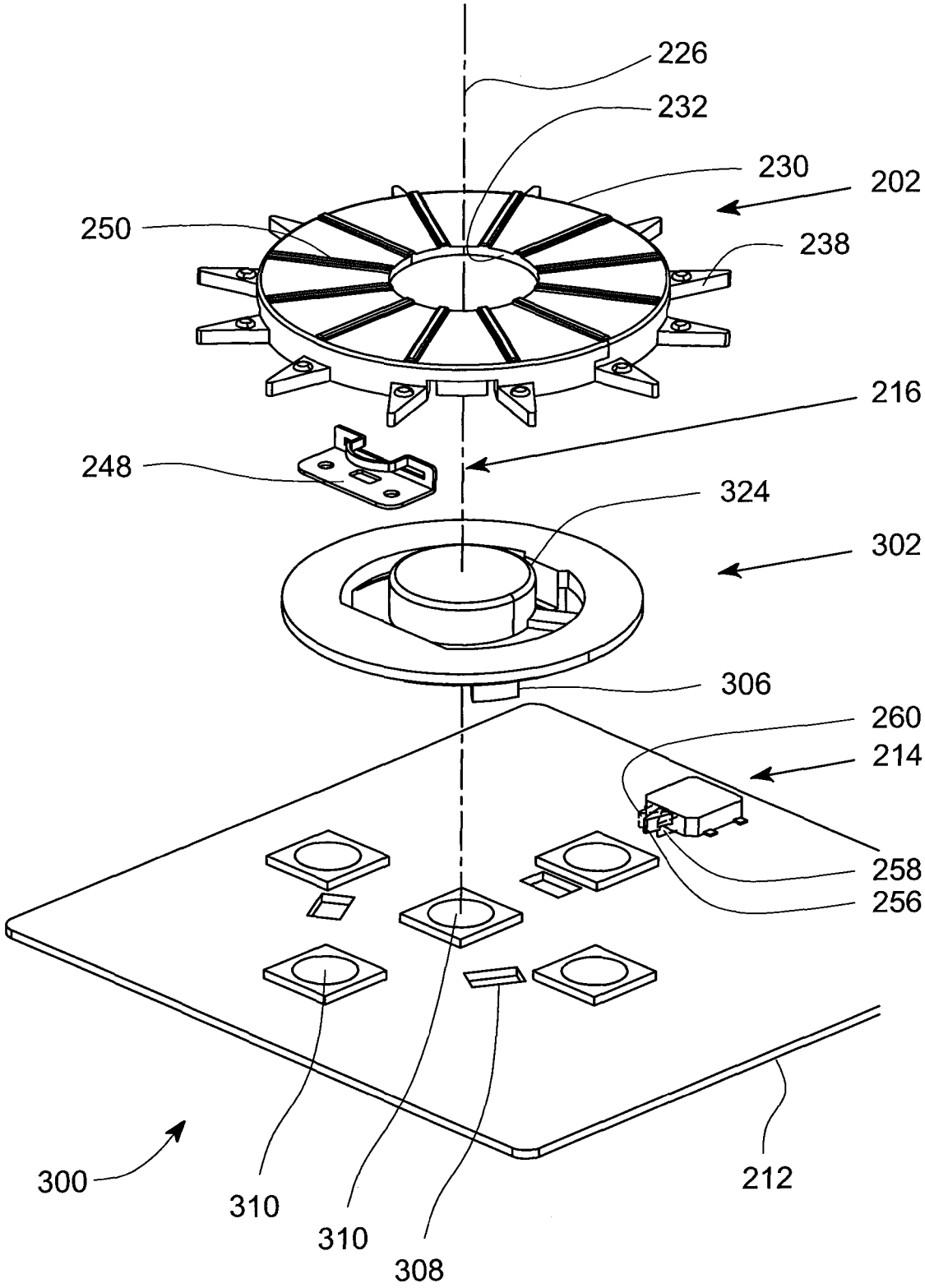
FIG. 6 is an exploded top view of the rotary switch assembly of FIG. 5.

Turning to FIGS. 5 and 6, an alternative embodiment of a rotary switch assembly 200 formed in accordance with the present invention is shown. The rotary switch assembly 200 is substantially similar in construction and operation as the rotary switch assembly of FIGS. 1-4. Accordingly, parts of similar function and construction have been given the same reference number as those of the previous embodiment, with the exception that the leading numeral "1" has been exchanged with the numeral "2" for convenience. Generally described, the most notable departures from the design of the rotary switch assembly of FIGS. 1-4 in this embodiment reside in the configuration of the rotary switch assembly 200 such that the orientation of the central axis 226 is substantially perpendicular to the PWB 212, and the placement of a push activated switch assembly 300 at least partially within the central aperture 232.

Examining these differences in greater detail, the rotary switch assembly 200 includes a dial assembly 202 formed from a propeller 230. The propeller 230 has a plurality of projecting members 238 which extend radially outward from a main body 250 of the dial assembly 202. The projecting members 238 are sized and positioned to selectively move an actuator 256 of a switch 214 between a first and second position 258 and 260 when the dial assembly 202 is rotated either clockwise 206 or counter clockwise 208. Both the actuator 256 and the projecting members 238 are preferably oriented substantially perpendicular to the central axis 226.

A biasing assembly 216 has a spring 248 which selectively engages recesses disposed in the propeller 230. The recesses are substantially identical to the recesses of the previous described embodiment, and therefore are not illustrated herein for the sake of brevity. Like the previous embodiment, the spring 248 interacts with the recesses to both provide positive feedback to the user during operation and to aid in retaining the propeller 230 in selected positions.

The dial assembly 202 is rotatingly received by the push activated switch assembly 300. More specifically, the push activated switch assembly 300 includes a main body 302 having a stub shaft 324. The stub shaft 324 is adapted to be received within the central aperture 232 of the propeller 230 such that during use, the dial assembly 202 can be selectively rotated about the stub shaft 324 by the user. The main body 302 is retained to the PWB 212 by a series of mounting tabs 306 which lockingly interface with a series of corresponding mounting apertures 308 disposed in the PWB 212.

The push activated switch assembly 300 also includes one or more dome switches 310. The dome switches 310 are adapted to selectively activate or deactivate a circuit when depressed. Moreover, during use, the main body 302 may be selectively depressed and/or tilted out of alignment with axis 226 to depress one of the dome switches 310 to result in the activation or deactivation of a particular circuit on the PWB 212, to result in the performance of a selected task.

Preferably, the height of the rotary switch assembly 200, measured from the bottom of the dome switches 310 or the top surface of the PWB 212 to the top of the stub shaft 324 or propeller 230 is less than about 10 mm, or even smaller heights, such as less than about 8 mm, 6 mm, 4 mm, or 3 mm such that the rotary switch assembly 200 has a low profile.

Preferably the propeller 230 has an outer diameter that is less than about 50 mm, or even smaller diameters such as less than about 40, 30, or 20 mm.

Advantages

A rotary switch assembly formed in accordance with the present invention may provide one or more of the following advantages:

a) a low profile;
b) a small foot print;
c) inexpensive to manufacture;
d) reliable;
e) less prone to failure;
f) less complicated;
g) does not require precision manufacturing techniques and components;
h) permits the use of a centre mounted switch assembly; and
i) more versatile in the orientations in which it can be mounted relative to a PWB.

Variations

Throughout the description of this specification, the word "comprise" and variations of that word such as "comprising" and "comprises", are not intended to exclude other elements, components, integers or steps.

It will of course be realised that while the foregoing has been given by way of illustrative example of this invention, all such and other modifications and variations thereto as would be apparent to persons skilled in the art are deemed to fall within the scope of this invention as is hereinbefore described.

The invention claimed is:

1. A rotary switch assembly comprising:

(a) a dial assembly (102) having a main body disposed about a centre aperture, the main body rotatable about a central axis (126) in both a clockwise direction and a counter clockwise direction, the dial assembly including at least one projecting member (138) extending outward from the main body; and (b) a switch (114) having an actuator (156) moveable in a first direction to a first position for activating a first circuit and moveable in a second direction to a second position for activating a second circuit, wherein the actuator is positioned relative to the dial assembly such that when the dial assembly is rotated clockwise, the projecting member interacts with the actuator to result in the actuator moving in the first direction to the first position, and when the dial assembly is rotated counter clockwise, the projecting member (138) interacts with the actuator (156) to result in the actuator moving in the second direction to the second position, wherein the rotary switch assembly is mounted to a printed wiring board (112) such that the central axis (126) is oriented substantially parallel to the printed wiring board.

2. The rotary switch assembly of claim 1, wherein a height of the rotary switch assembly (100) is less than about 10 mm.

3. The rotary switch assembly of claim 1, wherein a height of the rotary switch assembly (100) is less than about 5 mm.

4. The rotary switch assembly of claim 1, wherein an outer diameter of the dial assembly (102) is less than about 25 mm.

5. The rotary switch assembly of claim 1, wherein the projecting member (138) is oriented to extend outward from the main body (150) of the dial assembly (102) in a direction substantially parallel to the central axis (126).

6. The rotary switch assembly of claim 1, wherein the projecting member (138) is oriented to extend outward from the main body (150) of the dial assembly (102) in a direction substantially parallel to the central axis (126), and wherein the projecting member includes an outer facing cam surface (152) adapted to engage the actuator (156) as the dial assembly is rotated in either the clockwise or counter clockwise direction and an inner facing cam surface (154) adapted to engage the actuator (156) as the dial assembly is rotated in the other direction.

7. The rotary switch assembly of claims 1, wherein the dial assembly (102) includes at least a first recess and a second recess, wherein the rotary switch assembly includes a biasing assembly (116) for biasing a retaining member into either the first recess or the second recess to hold the dial assembly (102) in a selected position, and wherein when the dial assembly is rotated, the retaining member is adapted to be driven from the first recess to the second recess or from the second recess to the first recess.

8. The rotary switch assembly of claim 1, wherein the actuator is oriented substantially parallel to the central axis.

9. The rotary switch assembly of claim 1, wherein the actuator is biased to normally reside in a central default position, and wherein when the dial assembly is rotated in the clockwise direction, the projecting member drives the actuator from the central default position to the first position, and when the dial assembly is rotated in the counter clockwise direction, the projecting member drives the actuator from the central default position to the second position.

10. The rotary switch assembly of claim 1, wherein the switch (114) is a two-way direction detector switch.

11. A rotary switch assembly comprising:

(a) a dial assembly (102) having a main body disposed about a centre aperture, the main body rotatable about a central axis (126) in both a clockwise direction and a counter clockwise direction, the dial assembly including at least one projecting member (138) extending outward from the main body; and (b) a two-way direction detector switch (114) having an actuator (156) moveable in a first direction to a first position for activating a first circuit and moveable in a second direction to a second position for activating a second circuit, wherein the actuator is positioned relative to the dial assembly (102) such that when the dial assembly is rotated clockwise, the projecting member (138) interacts with the actuator to result in the actuator moving in the first direction to the first position, and when the dial assembly (102) is rotated counter clockwise, the projecting member (138) interacts with the actuator to result in the actuator moving in the second direction to the second position, wherein the rotary switch assembly has a low profile having a height less than about 6 mm; and the rotary switch assembly is mounted to a printed wiring board (112) such that the central axis (126) is orient substantially parallel to the printed wiring board.

* * * * *